US005102139A

United States Patent [19]

Greig

[11] Patent Number: 5,102,139

[45] Date of Patent: Apr. 7, 1992

[54] GOLF BALL RETRIEVER AND MARKER EMPLACER

[76] Inventor: Randall S. Greig, 6430 Preston Ave., #E, Livermore, Calif. 94550

[21] Appl. No.: 555,934

[22] Filed: Jul. 20, 1990

[51] Int. Cl.[5] ..... A63B 47/02; A63B 53/04

[52] U.S. Cl. ..... 273/162 D; 273/162 E; 294/19.2; 294/24

[58] Field of Search ..... 294/19.1, 19.2, 24, 294/65.5, 99.1; 273/32 A, 32 B, 32 D, 32 F, 32 R, 32.5, 162 R, 162 D, 162 E, 162 F, 169, 194 R, 194 A

[56] References Cited

U.S. PATENT DOCUMENTS

| | | | |
|---|---|---|---|
| D. 217,483 | 5/1970 | Jackson | 273/162 E X |
| 2,448,644 | 9/1948 | Williams | 294/19.2 |
| 2,538,325 | 1/1951 | Pfeiffer | 294/19.2 |
| 3,462,184 | 8/1969 | Russell | 294/19.2 |
| 3,520,569 | 7/1970 | Anderson | 294/19.2 |
| 4,180,288 | 12/1979 | Sievers | 294/19.2 |
| 4,248,430 | 2/1981 | Kepler | 294/19.2 X |
| 4,313,604 | 2/1982 | Baxter | 294/19.2 X |
| 4,313,632 | 2/1982 | King | 294/19.2 |
| 4,580,784 | 4/1986 | Brill | 294/19.2 X |
| 4,787,632 | 11/1988 | Nigrelli et al. | 294/19.2 X |

*Primary Examiner*—Johnny D. Cherry
*Attorney, Agent, or Firm*—Harris Zimmerman

[57] ABSTRACT

A golfing accessory, preferably a built-in component of a putter, enables a ball to be lifted and re-emplaced while the golfer remains in an upright posture. In the preferred form, the device releases a ball position marker as the ball is being engaged and recovers the marker during re-emplacement of the ball. The apparatus has a handle shaft with a head at the lower end from which a pair of resilient tangs extend. The tangs have a spacing slightly smaller than the diameter of the ball and have convergent ends. The tangs are traveled down along opposite sides of the ball to a position below the center of the ball in order to grip the ball for lifting. A leaf spring initially clamps the marker to the head but is deflected by the ball as it is being engaged by the tangs and thereby releases the marker. A magnet in the head enables retrieval of the marker without bending over.

8 Claims, 2 Drawing Sheets

GOLF BALL RETRIEVER AND MARKER EMPLACER

TECHNICAL FIELD

This invention relates to the game of golf and more particularly to apparatus for lifting a golf ball and for marking the position of the ball. In the preferred form, the apparatus is a built-in component of a golfer's putter.

BACKGROUND OF THE INVENTION

A golfer must frequently bend over or squat or kneel in the course of the game. For example, a golfer marks the position of the ball with a coin or similar object and then lifts the ball from the green when the game is to be temporarily interrupted to allow other golfers to play through. The ball is then re-emplaced and the marker is retrieved when the game is resumed. The golfer cannot remain in an upright posture while performing these and other operations unless specialized accessories are available to make that possible.

Most golfers would prefer to minimize the amount of bending over or the like that is required in the course of the game. Such exertions are an inconvenience for many players and can be a more serious problem for others such as the elderly and physically handicapped persons.

An accessory for lifting and re-emplacing a golf ball while the player remains upright should ideally have a simple and economical construction and preferably should be a component of some other accessory which the golfer already carries rather than adding to the amount of equipment which must be transported about in the course of the game. Preferably such an accessory should enable emplacement and retrieval of a ball position marker, as well as the ball itself, while the golfer remains upright.

The present invention is directed to overcoming one or more of the problems discussed above.

SUMMARY OF THE INVENTION

In one aspect of the present invention, apparatus for enabling lifting and re-emplacement of a golf ball while the golfer remains in an upright posture includes a shaft adapted for gripping by the golfer and which has a head at one end. A pair of resilient tangs extend from the head in substantially similar directions, the tangs being spaced apart by a distance which is smaller than the diameter of the golf ball. The outer end regions of the tangs are convergent.

In another aspect, the invention further includes a golf ball position marker. A resilient member extends from the head at a location above the tangs and has an end positioned to clamp the marker against the head. An intermediate region of the resilient member is contacted and deflected by the ball when the tangs are forced down along opposite sides of the ball whereby the marker is released from the head at that time.

In still another aspect, the invention provides a golf putter which is also usable for lifting and re-emplacing a golf ball while the golfer remains in an upright posture and for emplacing and retrieving a ball position marker while the golfer remains in that posture. The putter includes a shaft for gripping by the golfer and a head at the lower end of the shaft that has a flat front surface for impacting a golf ball. A pair of resilient tangs extend rearwardly from the back of the head, the tangs being coplanar and being spaced apart a distance that is smaller than the diameter of the ball. The tangs have convergent outer end regions spaced from the back of the head by a distance which is also smaller than the ball diameter. A resilient leaf spring extends from the back of the head at a location that is above the tangs and substantially equidistant from each of the tangs. The spring has a distal end which clamps a golf position marker against the back of the head when the spring is in an undeflected condition. The spring is deflected upward by the ball and releases the marker when the tangs are traveled down along opposite sides of the ball. The marker is formed at least in part of ferromagnetic material and a permanent magnet is secured to the head to enable retrieval of the marker while the golfer remains in the upright posture.

A golfer may easily lift a ball from the green while remaining in a standing position by grasping the shaft or handle of the apparatus and manipulating the two resilient tangs down along opposite sides of the ball. The tangs are wedged apart as they pass by the widest portion of the ball and then return towards each other to clasp the ball to the head at the base of the shaft. In the preferred form of the invention, a ball position marker is clamped to the head by a resilient member which is deflected by the ball as it is being engaged by the tangs causing an automatic release of the marker. The ball may be re-emplaced by clamping it against the green with the toe of one foot while the tangs are pulled away from the ball. In the preferred form, a magnet at the head of the device enables retrieval of the marker while the golfer remains standing.

The invention, together with further aspects and advantages thereof, may be further understood by reference to the following description of the preferred embodiment and by reference to the accompanying drawings.

DETAILED DESCRIPTION OF THE PREFERRED EMBODIMENT

Figure 1:
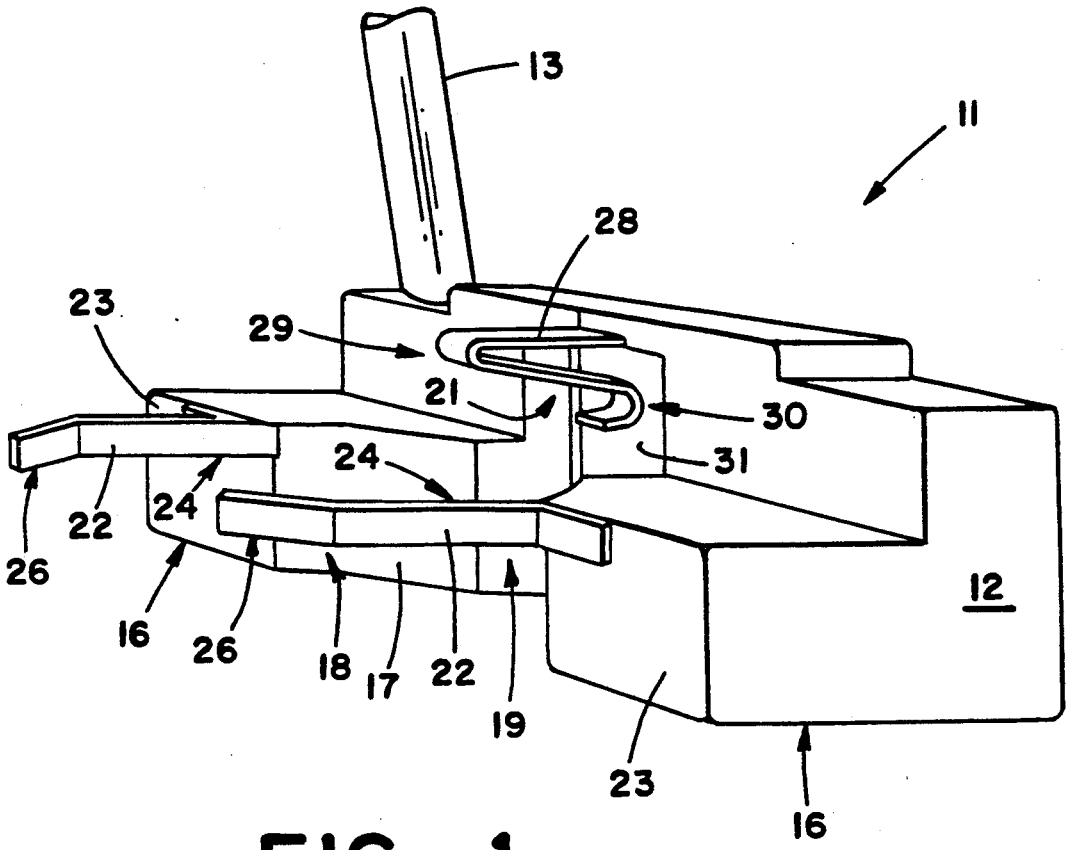
FIG. 1 is a perspective view of a golfer's putter embodying an example of the invention.
Figure 2:
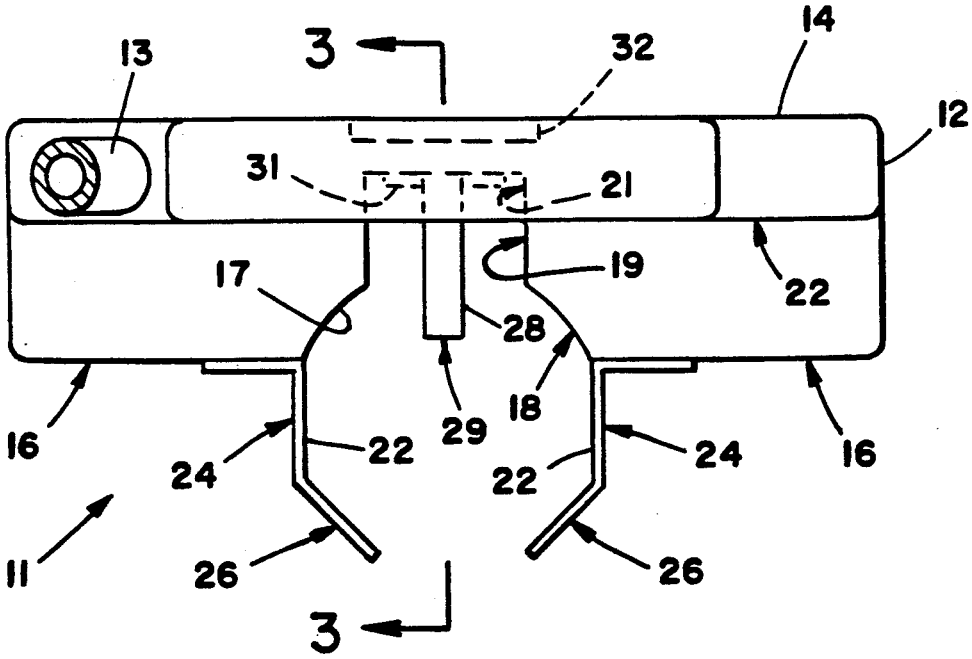
FIG. 2 is a top view of the head of the putter of FIG. 1.

Referring jointly to FIGS. 1 and 2 of the drawings, the apparatus 11 for enabling lifting and re-emplacement of a golf ball while the golfer remains in an upright posture is preferably also designed to serve as a putter although it may also be built into other types of golfing equipment having a head 12 secured to the bottom end of a shaft or handle 13 that is adapted for gripping by a golfer.

The head 12 of this embodiment of the invention has a flat front surface 14 for impacting the golf ball during putting and shaft 13 extends upward from a location close to one side of the head. The head 12 has a pair of rearwardly extending benches 16 at the lower region of the head which benches are spaced apart to define a golf ball receiving indentation 17 at the back of the head.

The rear region 18 of indentation 17 is sufficiently broad to receive and seat a portion of a standard spherical golf ball while the more forward region 19 of the indentation is narrower and extends into a marker receiving recess 21 in the back of the head 12.

The golf ball is gripped by a pair of tangs 22 that extend rearward from the back surfaces 23 of benches 16, the tangs being at opposite sides of the ball receiving indentation 17 and being formed of resilient material. Tangs 22 are coplanar and have linear front sections 24 that are parallel and which are spaced apart by a distance that is smaller than the diameter of a standard golf ball. The length of the front sections 24 is also smaller than the golf ball diameter. The outer end regions 26 of tangs 22 are angled relative to the front sections 24 and are convergent.

Figure 3:
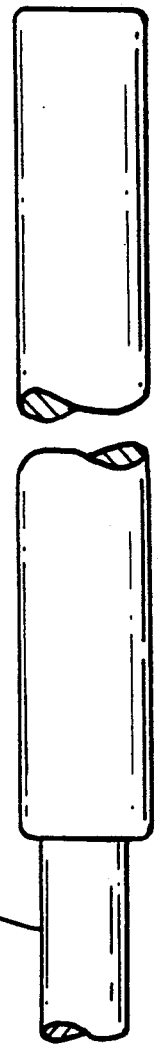
FIG. 3 is an elevation section view taken along line 3—3 of FIG. 2 with the shaft and handle of the putter being shown in foreshortened form.
Figure 3:
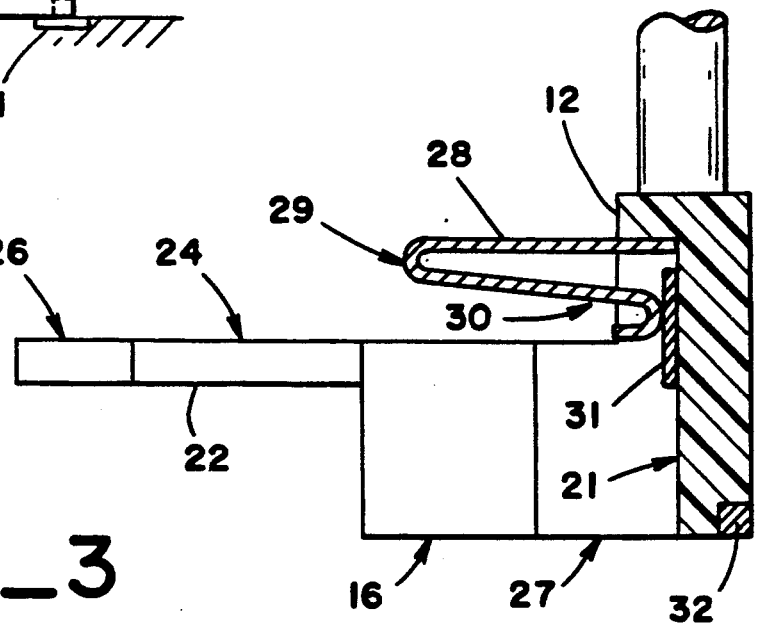

Referring to FIGS. 1 and 3 in conjunction, the tangs 22 are spaced above the bottom or undersurface 27 of head 12 by a distance which is smaller than the radius of the golf ball. Thus, the tangs 22 may be traveled down along opposite sides of a resting golf ball and will spread apart to pass the widest region of the ball after which the front sections 24 of the resilient tangs will return to a parallel relationship. This situates the tangs 22 directly below opposite sides of the ball. Raising of the putter 11 will then carry the ball upward.

An additional resilient member 28, which is a leaf spring in this embodiment, extends rearwardly from the back of head 12 at a location which is above tangs 22 and which is centered relative to the tangs. Member 28 is positioned to be deflected upward by the ball as the tangs 22 are traveled down along opposite sides of the ball. The member 28 then exerts a force against the ball that holds it down against the tangs 22 and which urges the ball against the convergent ends 26 of the tangs. Thus, the ball is effectively gripped and will not dislodge from the apparatus 11 as it is being lifted. Member 28 has a spring constant which enables it to restrain movement of the ball relative to tangs 22 but which does not create a force against the ball that is strong enough to spread the tangs 22 and thereby allow the ball to drop.

The resilient member 28 of this embodiment of the invention is also a means for carrying a golf ball position marker 31 at head 12 and for releasing the marker in conjunction with the lifting of a ball by the apparatus 11.

For this purpose, the resilient member 28 is a leaf spring having an intermediate region 29 positioned to be contacted and deflected by a golf ball as described above and having a distal end 30 that returns back towards head 12 and into recess 21. The distal end 30 clamps a golf ball position marker 31 against head 12 within recess 21 when the resilient member 28 is in the undeflected condition. Upward deflection of the intermediate region 29 of member 28 by a golf ball in the manner previously described draws the distal end 30 away from the head 12 and marker 31. This releases the marker 31 which then drops to the ground through recess 21 which extends to the undersurface 27 of the head 12.

Marker 31 is preferably formed of steel or other ferromagnetic material. This enables retrieval of the marker 31, while the golfer remains standing, by means of a small permanent magnet 32 which is secured to the putter 11. The magnet 32 is preferably embedded in the material o head 12 and extends along the front region of the undersurface 27 of the head.

Figure 4A:
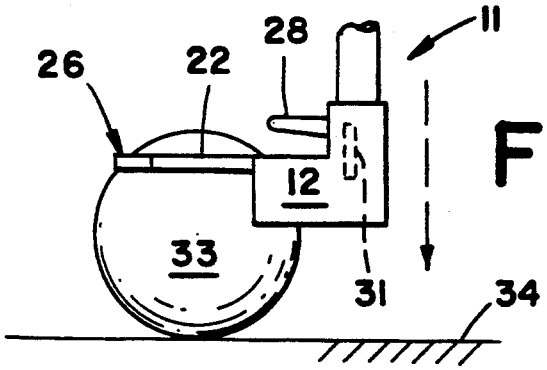
FIGS. 4A to 4C are side views depicting successive stages in the lifting and re-emplacing of a golf ball by use of the invention.
Figure 4B:
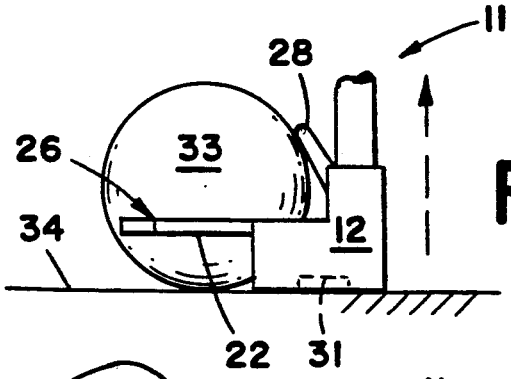

In use, with reference to FIG. 4A, a golf ball 33 may be lifted from the green 34 by positioning the tangs 22 over opposite sides of the ball. Downward movement of the putter 11 then causes a temporary spreading of the tangs 22 after which the tangs return towards each other and engage the ball in the manner previously described and as is depicted in FIG. 4B. This movement causes the resilient member 28 to be deflected upward and tensioned by the ball 33. This releases marker 31, in the manner which has also been described. The tensioned member 28 then exerts a force against ball 33 which inhibits dislodgement of the ball as the putter 11 is raised to retrieve the ball.

Figure 4C:
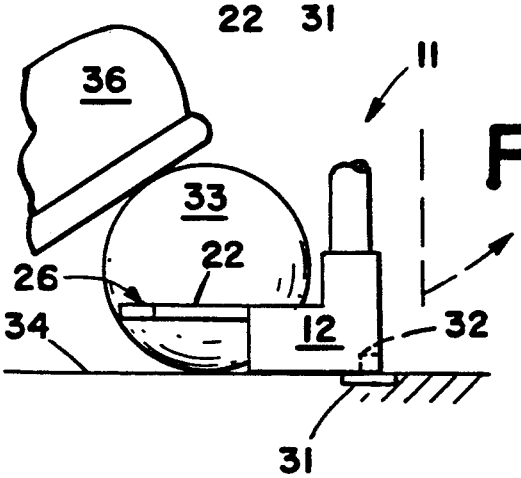

Referring to FIG. 4C, the ball 33 may be re-emplaced at the original location by positioning head 12 over the marker 12. Downward pressure is applied to the ball 33 with the toe region 36 of one of the golfer's feet. The head 12 may then be pivoted away from ball 33 to disengage the ball from putter 11.

Placement of magnet 32 over the marker 31 reattaches the marker to head 12. Thus, the marker 31 can also be retrieved for reuse while the golfer remains in an upright posture. The marker 31 is shown embedded in the underlying surface 34 in FIG. 4C since that surface is typically a soft turf of grass. The head 12 may be slightly canted when the marker 31 rests on a hard surface.

While the invention has been described with reference to a single preferred embodiment, many modifications and variations are possible and it is not intended to limit the invention except as defined in the following claims.

I claim:

1. Apparatus for enabling lifting and re-emplacement of a golf ball by a golfer while the golfer remains in an upright posture, said apparatus being comprised of an elongate shaft adapted for gripping by said golfer, a head secured to one end of said shaft and which has a bottom surface, a pair of resilient tangs extending from said head in substantially similar horizontal directions when said shaft is in a substantially upright orientation and said bottom surface of said shaft is abutted against the ground, said tangs being spaced apart by a distance which is smaller than the diameter of said golf ball and being spaced above said bottom surface of said head by a distance that is smaller than the radius of said golf ball and wherein said tangs have convergent outer end regions, and a resilient member extending from said head at a location which is above said tangs, said resilient member being positioned to urge said golf ball against said convergent ends of said tangs when said golf ball is between said tangs.

2. The apparatus of claim 1 further including means for carrying a golf ball position marker at said head and for releasing said marker from said head in response to clasping of a golf ball by said tangs.

3. The apparatus of claim 2 further including means for re-attaching said marker to said head in response to said re-emplacement of said golf ball by said apparatus.

4. The apparatus of claim 3 wherein said marker is formed at least in part of ferromagnetic material and wherein said means for re-attaching said marker to said head includes a magnet secured to said head at a location thereon which overlies said marker when a golf ball situated between said tangs is on the ground at a location adjacent to said marker.

5. The apparatus of claim 1 wherein said resilient tangs extend from a back surface of said head and wherein said head has a front surface that is substantially flat enabling said apparatus to be also used as a golf putter.

6. Apparatus for enabling lifting and re-emplacement of a golf ball by a golfer while the golfer remains in an upright posture, said apparatus being comprised of an elongate shaft adapted for gripping by said golfer, a head secured to one end of said shaft, and a pair of resilient tangs extending from said head in substantially similar directions, said tangs being spaced apart by a distance which is smaller than the diameter of said golf ball, said tangs having convergent outer end regions, further including a golf ball position marker and a resilient member extending from said head at a location above said tangs and having an end positioned to clamp said marker against said head, said resilient member having an intermediate region positioned to be contacted and deflected by said golf ball when said tangs are forced down along opposite sides of said golf ball whereby said marker is released from said head as said tangs are forced down along opposite sides of said golf ball.

7. The apparatus of claim 6 wherein said head has a golf ball receiving region situated between said tangs and a marker receiving recess facing said region between said tangs which recess extends down to the undersurface of said head, and wherein said resilient member is a curving leaf spring which extends out from said head above said tangs and at a centered location relative thereto and then extends back towards said head and into said recess to bear against said marker therein.

8. A golf putter which is also usable for lifting and re-emplacing a golf ball while the golfer remains in an upright posture and for emplacing and retrieving a golf ball position marker while said golfer remains in said upright posture, comprising:

a shaft having an upper region adapted for gripping by said golfer and having a lower end, a head having a flat front surface for impacting a golf ball and having a back surface and an undersurface, a pair of resilient tangs extending rearwardly from said back surface of said head, said tangs being coplanar and being spaced apart a distance which is smaller than the diameter of said golf ball, said tangs having convergent outer end regions spaced apart from said back surface of said head by a distance which is smaller than said diameter of said golf ball, and a golf ball position marker adapted for disposition against said back surface of said head and being formed at least in part of ferromagnetic material, a resilient leaf spring extending rearwardly from said back surface of said head at a location which is above said tangs and substantially equidistant from each thereof, said spring being deflectable from an undeflected condition into a deflected condition, said spring being positioned to be deflected upward by said golf ball when said tangs are traveled downward along opposite sides of said golf ball, said leaf spring having a distal end which extends back towards said back surface of said head in position to clamp said marker against said back surface when the spring is in the undeflected condition, and a permanent magnet secured to said head.

* * * * *